United States Patent [19]

Kitchen et al.

[11] 4,371,152

[45] Feb. 1, 1983

[54] BOX SPRING ASSEMBLY WITH IMPROVED SPRING INSTALLATION CAPABILITY

[75] Inventors: John P. Kitchen, Georgetown, Ky.; Jack C. Mandusky, Adrian, Mich.

[73] Assignee: Hoover Universal, Inc., Saline, Mich.

[21] Appl. No.: 115,296

[22] Filed: Jan. 25, 1980

[51] Int. Cl.[3] ..... A47C 25/00; A47C 23/04; F16F 3/00; F16F 1/14

[52] U.S. Cl. ..... 267/103; 5/247; 5/255; 5/476; 267/154

[58] Field of Search ..... 267/107, 110, 112, 103, 267/154; 5/247, 255, 260, 267, 476, 478

[56] References Cited

U.S. PATENT DOCUMENTS

| | | | |
|---|---|---|---|
| 3,487,480 | 1/1970 | Slominski | 5/247 |
| 3,574,240 | 4/1971 | Slominski | 5/247 |
| 4,060,862 | 12/1977 | Kitchen et al. | 5/260 |
| 4,195,376 | 4/1980 | Kitchen | 5/255 |
| 4,238,861 | 12/1980 | Mizelle | 5/247 |

*Primary Examiner*—Alexander Grosz
*Attorney, Agent, or Firm*—Olsen and Stephenson

[57] ABSTRACT

A box spring assembly which includes a generally rectangular frame and a plurality of wire springs mounted on the frame and connected to each other so as to yieldably resist downwardly directed bedding loads. Each of the springs has an elongated body portion arranged above the frame and downwardly extending end portions, each of the end portions having a lower column section consisting of a straight length of spring wire and an upper section consisting of a plurality of substantially horizontal torsion bars and a plurality of angularly arranged connecting bars connected to and extending between the torsion bars so that in response to a downwardly directed bedding load, the upper section will yieldably collapse to accommodate the load and impart a feeling of soft support to the bedding user. The straight wire column is inclined inwardly so that it can bend slightly and cause a twisting of the torsion bar on which it is mounted. This action imparts a feeling of firm support to the bedding user. This combination of initial softness and subsequent firmness is desirable in bedding foundations for purposes of user comfort. In addition, the arrangement of parts facilitates manipulation of stapling tools to secure the mounting torsion bars to the frame.

5 Claims, 4 Drawing Figures

BOX SPRING ASSEMBLY WITH IMPROVED SPRING INSTALLATION CAPABILITY

BACKGROUND OF THE INVENTION

This invention relates generally to mattress foundation structures and more particularly to a box spring assembly of a type which utilizes non-coil springs. Box spring assemblies of this general type have been known since 1964, the first such spring assembly being disclosed in U.S. Pat. No. 3,286,281. Subsequently issued patents disclosing the same general type of box spring assembly are: U.S. Pat. Nos. 3,487,480; 3,506,987; 3,574,240; 3,574,241; 3,665,529; 3,680,157; 3,755,833; 3,824,639; 3,852,838; 4,060,862; 4,120,058; and 4,163,296. Box spring assemblies of the general type shown in the above list of patents, all of which are assigned to the assignee of this application, are advantageous with respect to the conventional box spring assemblies using coil springs because they provide a desired stiffer foundation for the mattress and contain a reduced amount of wire. These box spring assemblies are also advantageous from the standpoints of prolonged service life, ease of assembly and cost of manufacture.

Additional box spring assemblies of this general type are shown in U.S. Pat. Nos. 3,596,299; 3,722,013; 3,825,960; 3,833,948; 3,835,485; 3,869,740; 3,990,121; and 4,000,531.

The present invention provides a formed wire box spring assembly which utilizes improved springs. The spring in the present box spring assembly has an upper portion which yieldably collapses under load to impart a feeling of softness when the bedding occupant first reclines on a mattress supported on the box spring assembly of this invention. This collapse of the upper section is accompanied by a fast build up of resistance to load to reduce the chance of excessive deflection. The initial collapse of the upper section is then followed by a more firm resistance to load by the lower section of the spring which consists principally of a short generally upright length of straight spring wire which functions as a yieldable column supported on still another tension bar to support the bedding load. The column imparts a feeling of firm support to the bedding user following the initial feeling of softness.

The components of the spring end portions are arranged so as to relatively evenly divide the load so that all parts are evenly stressed to avoid any permanent set. The parts are also arranged so as to facilitate the use of stapling tools in securing the springs to the frame.

It is an object of the present invention, therefore, to provide a formed wire box spring assembly having improved formed wire springs capable of imparting a desired feeling of comfort to the bedding user, and which can readily be frame mounted to form the assembly.

SUMMARY OF THE INVENTION

The box spring assembly of this invention consists of a generally horizontal rectangular frame and a plurality of wire springs mounted on the frame and connected to each other so as to yieldably resist downwardly directed bedding loads, each of the springs being formed of spring steel wire having an elongated body portion arranged above the frame and downwardly extending end portions secured to the frame. Each of the spring end portions has an upper section consisting of a plurality of substantially horizontal torsion bars and a plurality of angularly arranged connecting bars connected to and extending between the torsion bars so that the upper section can yieldably collapse when subjected to a downwardly directed bedding load. Each spring end section also has a lower section consisting of a straight length of spring wire forming an inclined column formed integral at the upper end with the upper section of the spring and formed integral at its lower end with a mounting torsion bar secured to the frame.

The wire springs in the box spring assembly of this invention are configured so that the mounting torsion bars are on the outsides of the spring at the lower ends of the inwardly inclined columns. In these locations, the mounting torsion bars are easily accessible to power stapling guns without interference from the other parts of the spring.

Springs constructed in accordance with this invention impart a high degree of comfort to bedding users reclined on mattresses supported on the box spring assemblies of this invention. This is due to the fact that the springs of this invention impart a desired feeling of initial softness to the bedding user to give the user a feeling of soft support. Once the user is fully supported on the mattress, the column-type lower sections of the spring end portions in this invention give a feeling of firm, solid, reliable support to the box spring assembly which is highly desirable from the standpoint of one reclining on a mattress supported on the box spring assembly. To such a user, the feeling that the mattress is firmly and reliably supported is of prime importance.

Accordingly, the principal object of the present invention is to provide an improved formed wire box spring assembly that is advantageous from the standpoint of user comfort and reliability.

Further objects, features, and advantages of this invention will become apparent from a consideration of the following description, the appended claims, and the accompanying drawing in which:

Figure 1:
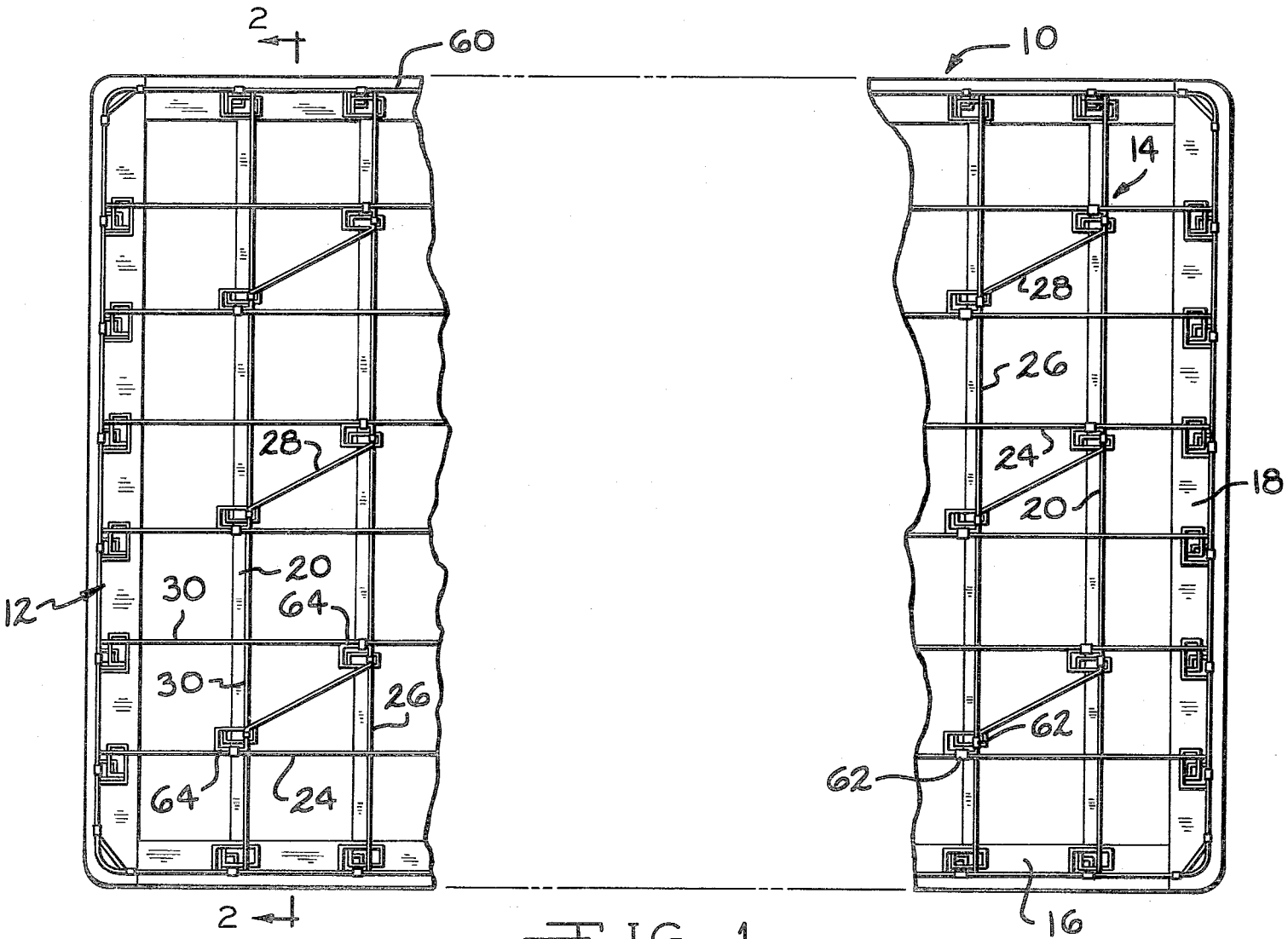
FIG. 1 is a plan view of the box spring assembly of this invention with the middle portion of the assembly being broken away for ease of illustration.

With reference to the drawing, the spring assembly of this invention indicated generally at 10, is illustrated in FIG. 1 as consisting of a generally rectangular horizontally disposed frame 12, usually formed of wood, and a wire spring assemblage 14 mounted on the top side of the frame 12. The frame 12 has side rails 16, end rails 18, and cross rails 20 which are secured to and extend between the side rails 16.

The spring assemblage 14 consists of a plurality of first main springs 24 which extend longitudinally of the frame 12 and a plurality of second main springs 26, which extend transversely of the main frame 12. The main springs 24 and 26 are supported intermediate their ends by intermediate springs 28. All of the springs 24, 26, and 28 are formed of spring steel wire and are substantially identical in that each has a generally horizontal body portion located above the frame 12 and a pair of depending end portions which are mounted on the frame 12. Accordingly, only a main spring is illustrated in detail in FIGS. 3 and 4, and only a main spring will be described in detail hereinafter with like numerals indicating like parts on the springs 24, 26, and 28.

Figure 2:
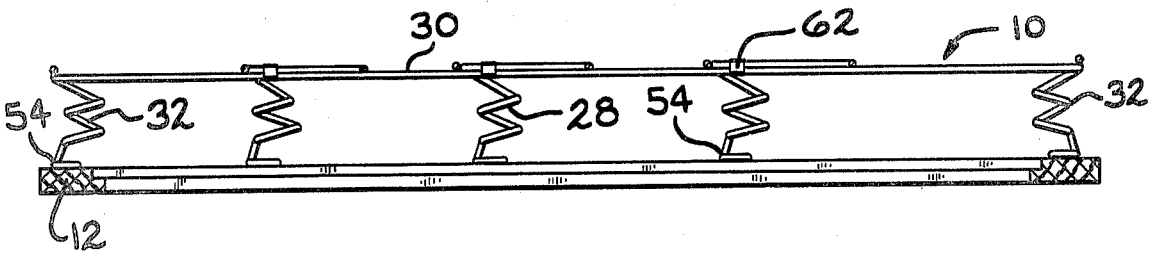
FIG. 2 is a transverse sectional view of the box spring assembly of this invention as seen from substantially the line 2—2 in FIG. 1.
Figure 3:
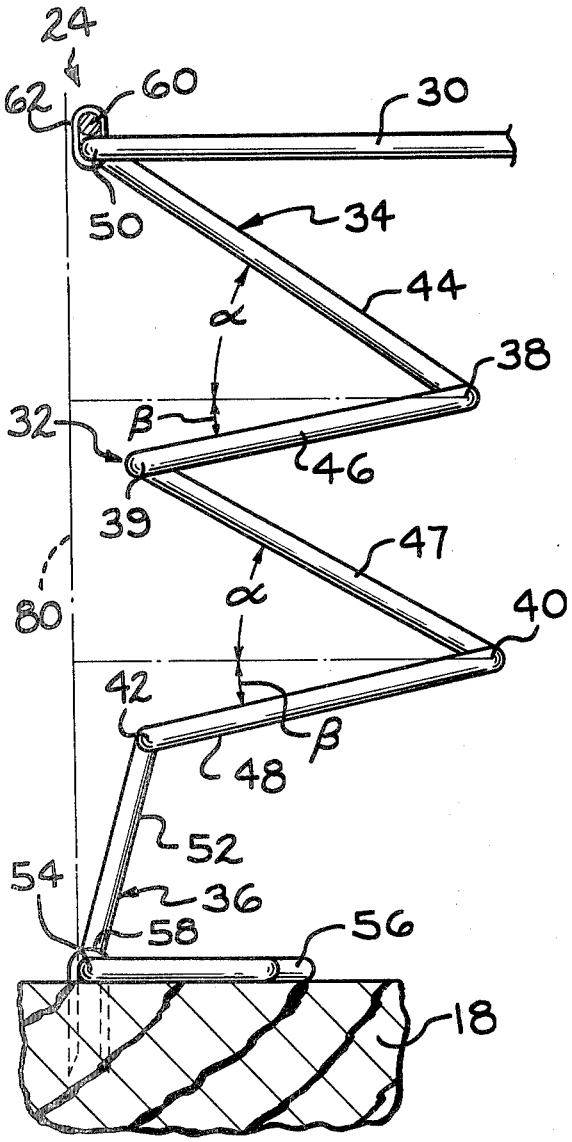
FIG. 3 is an enlarged side elevational view of the end portion of a wire spring in the assembly shown in FIG. 1.
Figure 4:
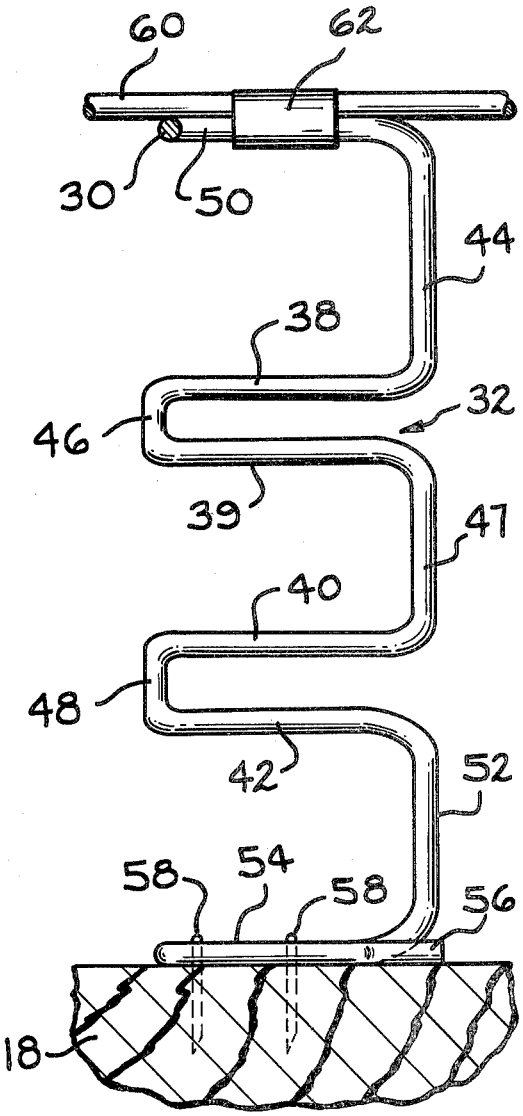
FIG. 4 is an end view of the spring portion shown in FIG. 3.

As shown in FIGS. 2 and 3, the spring 24 includes a generally horizontal body portion 30 disposed above the frame 12 a distance corresponding to the desired height of the box spring assembly 10, this height normally being the standard height for box springs in the bedding industry. A pair of yieldable end portions 32 extend downwardly from the ends of the body portion 30 and are secured to the frame 12. Each of the end portions 32 has an upper section 34 formed integral with one end of the body portion 30 and a lower section 36 which is supported on the frame 12.

The upper section 34 consists of a plurality of generally horizontal torsion bars 38, 39, 40, and 42 and a plurality of angularly related connecting bars 44, 46, 47, and 48 which are connected to and extend between the torsion bars 38, 39, 40, and 42 as shown in FIG. 3. At its upper end, the section 34 includes a torsion bar 50 which connects the body portion 30 to the connecting bar 44. The torsion bars 38 and 40 constitute inner torsion bars and the bars 39, 42, 50, and 54 constitute outer torsion bars in each end portion 32, the inner torsion bars being closer to the other end portion of the spring than the outer torsion bars.

The lower section 36 consists principally of a generally upright, inwardly and upwardly inclined straight length of wire 52 formed integral at its upper end with the torsion bar 42 and at its lower end with a mounting torsion bar 54 which extends transversely of the column 52 and is in longitudinal surface-to-surface contact with the end rail 18. A mounting foot 56 constitutes an extension of the torsion bar 54 and staples 58 are used to secure the torsion bar 54 to the end rail 18.

The spring assemblage 14 also includes, in addition to the main springs 24 and 26 and the intermediate springs 28, a border wire 60 which is generally rectangular in shape corresponding to the shape of the rectangular frame 12 and spaced a distance above the frame 12 corresponding to the desired height of the box spring assembly 10. The mounting bars 50 at the upper ends of the main springs 24 and 26 are disposed in a side-by-side relation with the border wire 60 and are secured to the border wire 60 by conventional wrap-around-type spring clips 62.

Each intermediate spring 28 is secured to adjacent main springs 24 by wrap-around clips 62 extending about the mounting bars 50 at the ends of the spring 28 and the body portions 30 of the main springs 24. Each intermediate spring body portion 30 is formed at its ends with portions 64 that are at right angles to the mounting bars 50. These right angle portions are also secured by wrap-around clips 62 to the body portions 30 of adjacent main springs 26. The result is a rectangular spring deck consisting of the body portions 30 of the springs 24, 26 and 28 and the border wire 60 which is disposed in a horizontal plane above the frame 12 and supported on the spring end portions 32. The end portions 32 resiliently support the deck so that it can yield to bedding loads to accommodate the usual body-supporting mattress (not shown) so that the mattress will impart the desired degree of sleeper comfort to the user.

The feet 56 at the ends of the main springs 24 are supported on the end rails 18 and secured thereto by the staples 58. The feet 56 at the ends of the main springs 26 are similarly supported on the side rails 16 and are secured thereto by similar staples (not shown). Likewise, the feet at the lower ends of the intermediate springs 28 are supported on the cross rails 20 and secured thereto by staples (not shown) like the staples 58.

As shown in FIG. 3, the mounting torsion bar 54 in each spring end portion 32 is located at an imaginary vertical plane 80 which is further from the opposite end portion of the spring than the plane of any other outer torsion bar. This location of the mounting torsion bars 54, coupled with the upwardly and inwardly inclined position of the column 52 enables the easy application of a stapling tool to the bar 54 for driving the staples 58.

In the use of the box spring assembly 10, the loads applied by the mattress occupant will be downwardly directed loads which are yieldably resisted by the spring end portions 32. The load on the spring deck described above acts to downwardly deflect the spring end portions 32 on which the deck is supported. During such deflection, the torsion bars 38, 39, 40, and 42 in the upper section 34 are twisted and the inherent resistance of the torsion bars to this twisting imparts the desired resilient resistance to the load. However, the normal occupant load on the spring deck is adequate to twist the torsion bars 38, 39, 40, and 42 so that the deck will yield and impart a feeling of softness to the mattress occupant.

As shown in FIG. 3, the connecting bars 44 and 47 are substantially parallel and, in their unloaded state, are inclined at an angle "$\alpha$" greater than the angle of inclination "$\beta$" of the reversely inclined bars 46 and 48.

As the upper section 34 is progressively deflected or collapsed, the resistance of the torsion bars 38, 39, 40 and 42 to twisting increases rapidly to increase the feeling of firmness in the support of the box spring assembly 10 and reduce the chance of excessive spring deflection. The arrangement of the torsion and connecting bars described above provides for a relatively equal sharing of the load by the bars so that no one bar carries a sufficiently high load to stress it beyond its elastic limit.

The column 52 provides relatively stiff resistance to load, but the column 52 can bend and will incline further inwardly so that the torsion bar 54 will be twisted and will help to resist the spring loads.

From the above description, it is seen that this invention provides an improved formed wire box spring assembly which includes the similar springs 24, 26, and 28. The springs are structured so as to impart a desired feeling of comfort and reliable support to the box spring user. The result is a spring deck consisting of the body portions 30 of the springs 24, 26, and 28 are bounded by the border wire 60 which is disposed in a horizontal plane above the frame 12 and supported on the spring end portions 32. Installation of the springs on the frame 12 is facilitated by the location of the mounting torsion bars 54 at the planes 80 and the provision of the columns 52 which are inclined upwardly and inwardly from the torsion bars 54.

What is claimed:

1. In a box spring assembly which includes a generally rectangular frame, a plurality of vertically deflectable wire springs mounted on said frame and connected to each other so as to yieldably resist downwardly directed bedding loads, each of said springs being formed of spring steel wire and having a generally horizontal body portion arranged above said frame and downwardly extending end portions, each of said end portions having an upper section and a lower section, said upper section comprising a plurality of substantially horizontal torsion bars and a plurality of angularly arranged connecting bars connected to and extending between said torsion bars, some of said torsion bars constituting inner torsion bars and others of said torsion bars constituting outer torsion bars, said inner torsion bars in each end portion being located in closer proximity to the other end portion of said spring than said outer torsion bars, said torsion bars being movable in response to torsional stressing thereof to enable downward yieldable collapsing deflection of said end portion, said lower section comprising a generally upright, upwardly and inwardly inclined column of wire, said column of wire terminating at the lower end thereof in a frame engaging torsion bar which constitutes an outer torsion bar and is spaced from the other end portion of said spring a distance at least as great as all of the other outer torsion bars in said one end portion, and connecting means securing said frame engaging torsion bar to said frame, said column of wire terminating at the upper end thereof at the lowermost of said outer torsion bars other than said frame engaging torsion bar, that connecting bar which connects such lowermost torsion bar to the immediately succeeding and lowermost, inner torsion bar being disposed at an inclination in the same upward and inward sense as said column of wire but more horizontal than said column of wire.

2. The structure according to claim 1 further including a border wire of generally rectangular shape disposed above and in general alignment with said rectangular frame, said uppermost torsion bars for at least some of said spring end portions being arranged side by side with said border wire, and wrap-around clip means connecting said uppermost torsion bars to said border wires.

3. The structure according to claim 1 wherein alternate ones of said connecting bars are oblique and inclined downwardly and inwardly, said alternate ones of said connecting bars being arranged in a substantially parallel relation, the remaining ones of said connecting bars being inclined downwardly and outwardly but to a substantially lesser degree than said alternate ones of said connecting bars.

4. A wire spring for a box spring assembly, said spring being formed of a single strip of spring steel wire and comprising an elongated generally horizontal body portion having downwardly extending end portions, each of said end portions having a lower column section consisting of a generally upright length of substantially straight wire inclined upwardly and inwardly and a yieldably collapsible section extending upwardly from the upper end of said lower section, said upper section including a plurality of substantially horizontal torsion bars and a plurality of angularly arranged connecting bars connected to and extending between said torsion bars, alternate ones of said connecting bars being oblique and being inclined downwardly and inwardly, said alternate ones of said connecting bars being arranged in a substantially parallel relation, the remaining ones of said connecting bars being inclined downwardly and outwardly but to a substantially lesser degree than said first-mentioned connecting bars, the lower one of said torsion bars extending transversely from the upper end of said column section, a mounting torsion bar at the lower end of said column section, said lower torsion bar in said collapsible section being located in a vertical plane disposed between the vertical planes in which said mounting torsion bars are located, said lower torsion bar in said collapsible section being connected to the lowermost of said remaining ones of said connector bars.

5. The structure according to claim 4 further including a mounting foot formed integral with and extending horizontally inwardly from each of said mounting torsion bars.

* * * * *